US006715310B2

(12) United States Patent
Kuo

(10) Patent No.: US 6,715,310 B2
(45) Date of Patent: Apr. 6, 2004

(54) BLOWER FOR AN AIR CONDITIONER WITH BETTER EFFECT IN COLD-AIR CIRCULATION

(76) Inventor: Chin-Sheng Kuo, P.O. Box 90, Tainan City (TW)

( * ) Notice: Subject to any disclaimer, the term of this patent is extended or adjusted under 35 U.S.C. 154(b) by 75 days.

(21) Appl. No.: 10/156,125

(22) Filed: May 29, 2002

(65) Prior Publication Data

US 2003/0221437 A1 Dec. 4, 2003

(51) Int. Cl.[7] ..... E06B 7/02; F24F 7/013
(52) U.S. Cl. ..... 62/262; 454/201
(58) Field of Search ..... 62/262, 263, DIG. 16, 62/259.1, 259.4, 428; 454/201, 275, 276, 355

(56) References Cited

U.S. PATENT DOCUMENTS 5,582,025 A * 12/1996 Dubin et al. ..... 62/262

FOREIGN PATENT DOCUMENTS

JP 08247534 A * 9/1996 ..... F24F/13/32
JP 2000355215 A * 12/2000 ..... B60H/1/34

* cited by examiner

*Primary Examiner*—Chen Wen Jiang

(57) ABSTRACT

A blower for an air conditioner with better effect in cold-air circulation in the present invention is to provide a faceplate and at least one cold-air blower, the faceplate having at least one wind outlet and at least one wind inlet, each of the cold-air blowers having an evaporator and a fan, each of the fans having a wind-blown opening aligned with each of the wind outlets of the faceplate, whereby the evaporators of the cold-air blowers are capable of sucking in air in a short distance directly from the wind inlets of the faceplate to become cold air that will be promptly and powerfully blown out of the wind outlets of the faceplate by the fans of the cold-air blowers so as to achieve a better effect in cold-air circulation.

1 Claim, 11 Drawing Sheets

BLOWER FOR AN AIR CONDITIONER WITH BETTER EFFECT IN COLD-AIR CIRCULATION

BACKGROUND OF THE INVENTION

1. Field of the Invention

This invention relates to a blower for an air conditioner with better effect in cold-air circulation, particularly to one comprising a faceplate and at least one cold-air blower, the faceplate having at least one wind outlet and at least one wind inlet, each of the cold-air blowers located on each of the wind outlets of the faceplate and having an evaporator and a fan, each of the fans having a wind-blowing opening aligned with each of the wind outlets of the faceplate, whereby the cold-air blowers are capable of sucking in air directly from the wind inlets of the faceplate to become cold air that will be promptly and powerfully blown out of the wind outlets of the faceplate so as to achieve an optimum effect in cold-air circulation.

2. Description of the Prior Art

Generally speaking, a known conventional blower for a central air conditioning system installed on a ceiling includes many wind-out faceplates disposed around an indoor machine and provided with wind outlets connected with the indoor main machine by windpipes and capable of blowing cold air into the room, and many wind-in faceplates disposed adjacent to the wind-out faceplates and provided with wind inlets connected with an outdoor machine by windpipes and capable of withdrawing hot air out of the room to the outdoor machine. Therefore, in such a conventional blower, wind-out faceplates and wind-in faceplates are installed in different locations and respectively connected with the indoor machine and the outdoor machine by windpipes, by which cold air needs to be transported by the windpipes before being blown out of the wind outlets of the wind-out faceplates. In order to make cold air evenly blown in the room, a lot of wind-out faceplates are installed in different locations of the room, which requires many windpipes of different length to be connected with the wind-out faceplates. However, cold air transported through such windpipes of different length is hard to keep the same temperature when it is blown out of the wind outlets of the wind-out faceplates installed in different locations so that the conventional blower can not achieve an even cooling effect.

SUMMARY OF THE INVENTION

The main purpose of the present invention to offer a blower for an air conditioner with better effect in cold-air circulation comprising a faceplate and at least one cold-air blower, the faceplate having at least one wind outlet and at least one wind inlet, each of the cold-air blowers having an evaporator and a fan, whereby the evaporators of the cold-air blowers are capable of sucking in air directly from the wind inlets of the faceplate to become cold air that will be promptly and powerfully blown out of the wind outlets of the faceplate by the fans of the cold-air blowers.

One primary feature of the present invention is to provide a faceplate having at least one wind outlet and at least one wind inlet; and, at least one cold-air blower each located on each of the wind outlets of the faceplate and having an evaporator and a fan, each of the fans having a wind-blowing opening aligned with each of the wind outlets of the faceplate.

One another feature of the present invention is to provide a faceplate having at least one wind outlet and at least one wind inlet; at least one cold-air blower each located on each of the wind outlets of the faceplate and having an evaporator and a fan, each of the fans having a wind-blowing opening aligned with each of the wind outlets of the faceplate; at least one wind-out cover each capable of being covered on each of the cold-air blowers and having at least one through hole; and, at least one wind-in cover each capable of being covered on each of the wind inlets of the faceplate and having at least one through hole each connected with each of the through holes of the wind-out cover by a windpipe.

One further feature of the present invention is to provide a faceplate having at least one wind outlet and a wind inlet; at least on cold-air blower each located on each of the wind outlets of the faceplate and having an evaporator and a fan, each of the fans having a wind-blowing opening aligned with each of the wind outlets of the faceplate; and, a wind-in cover capable of being covered on the wind inlet of the faceplate and all of the cold-air blowers.

One still further feature of the present invention is to provide a first faceplate having at least one wind outlet; a second faceplate having at least one wind inlet; and, at least one cold-air blower each located on each of the wind outlets of the first faceplate and having an evaporator and a fan, each of the fans having a wind-blowing opening aligned with each of the wind outlets of the first faceplate.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
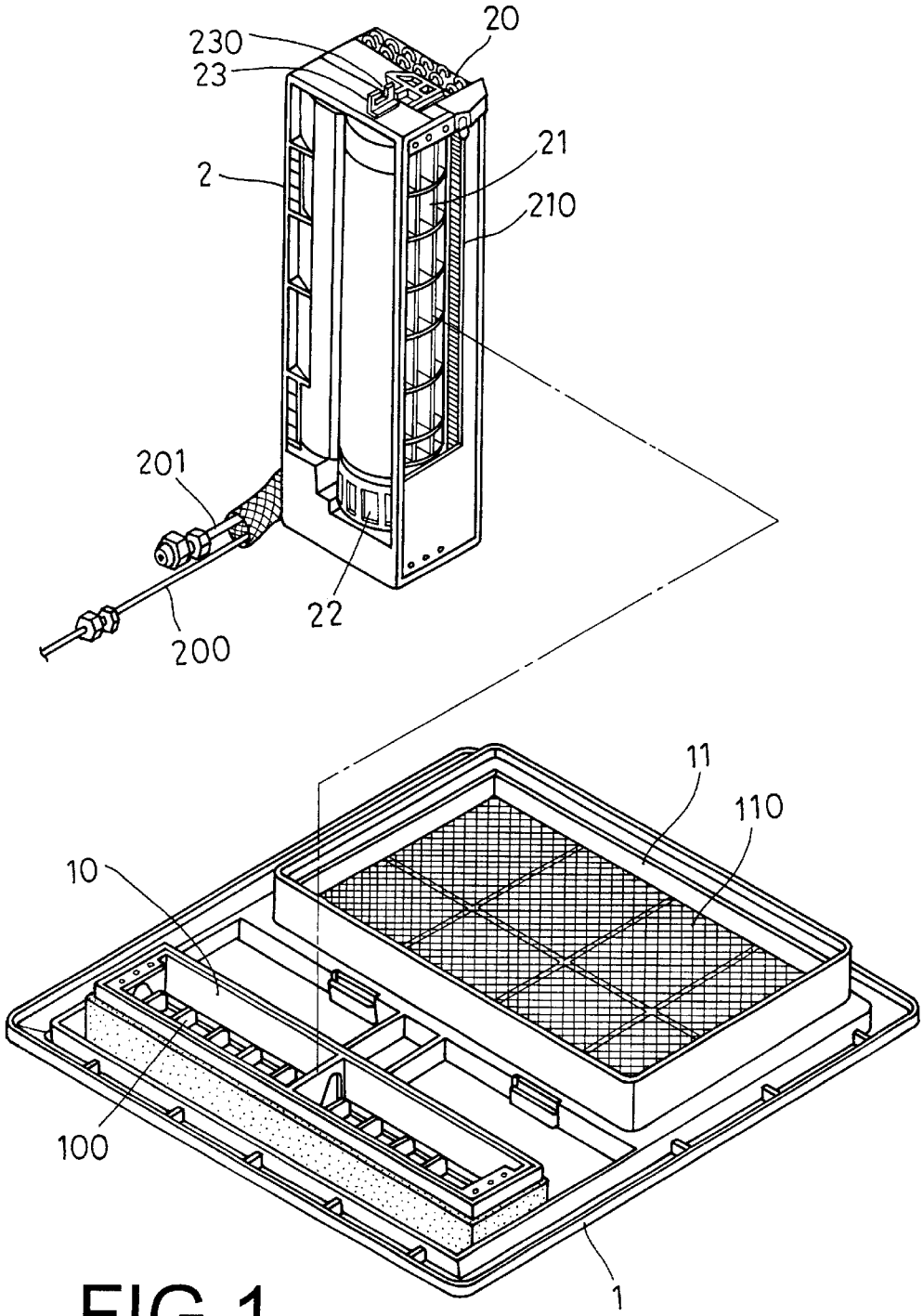
FIG. 1 is an exploded perspective view of a blower for an air conditioner with better effect in cold-air circulation in the present invention, showing a faceplate and a cold-air blower.

A first preferred embodiment of a blower for an air conditioner with better effect in cold-air circulation in the present invention, as shown in FIGS. 1 to 4, mainly includes a faceplate 1 and at least one cold-air blower 2.

The faceplate 1 has at least one wind outlet 10 and at least one wind inlet 11. Each of the wind outlets 10 has a plurality of adjusting leaves 100 disposed therein and capable of automatically turning direction. Each of the wind inlets 11 has an openable filter-net grille 110 disposed therein.

Each of the cold-air blowers 2 is located on each of the wind outlets 10 of the faceplate 1 and has an evaporator 20, a fan 21, a motor 22 disposed at one side of the fan 21 and actuating the fan 21, and two positioning plates 23. The evaporator 20 is provided with an inlet pipe 200 and an outlet pipe 201. The fan 21 has a wind-blowing opening 210 aligned with each of the wind outlets 10 of the faceplate 1. The two positioning plates 23 are disposed at proper places of both sidewalls of the cold-air blower 2 and each provided with a slot 230. The two positioning plates 23 are convenient for being firmly combined with two screw rods 30 by screw members 31. The two screw rods 30 are pre-enrooted in a concrete upper floor construction 3.

Figure 2:
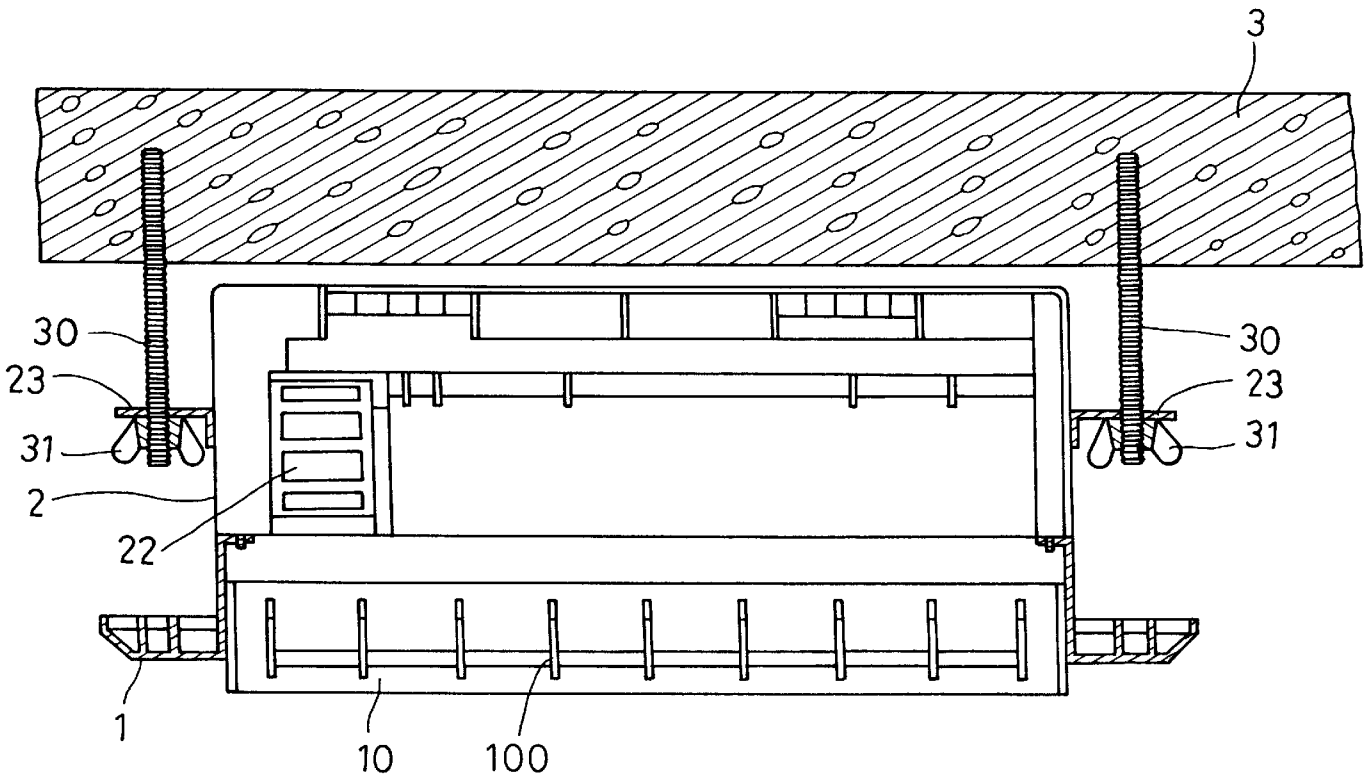
FIG. 2 is a schematic view of the blower for an air conditioner with better effect in cold-air circulation in the present invention, showing the cold-air blower installed to a concrete upper floor construction.
Figure 3:
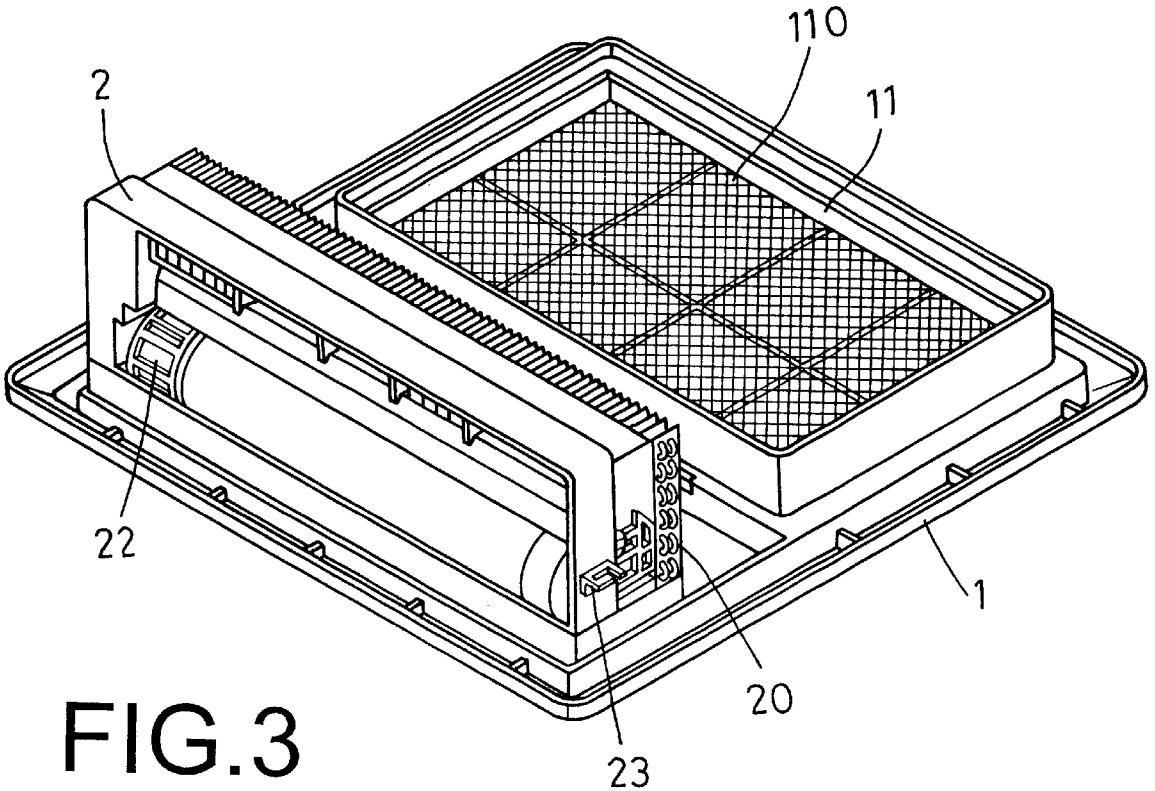
FIG. 3 is a perspective view of the blower for an air conditioner with better effect in cold-air circulation in the present invention, showing the construction of a first preferred embodiment.

In assembling, firstly extend the two screw rods 30 respectively through the slots 230 of the two positioning plates 23, and then use two screw members 31 to screw the two screw rods 30 tightly so that the cold-air blower 2 can be firmly installed on the concrete upper floor construction 3 in position, as shown in FIG. 2. Secondly, make the wind-blowing opening 210 of the fan 21 of the cold-air blower 2 aligned with the wind outlet 10 of the faceplate 1, and then combine them together, as shown in FIGS. 3 and 4.

Figure 4:
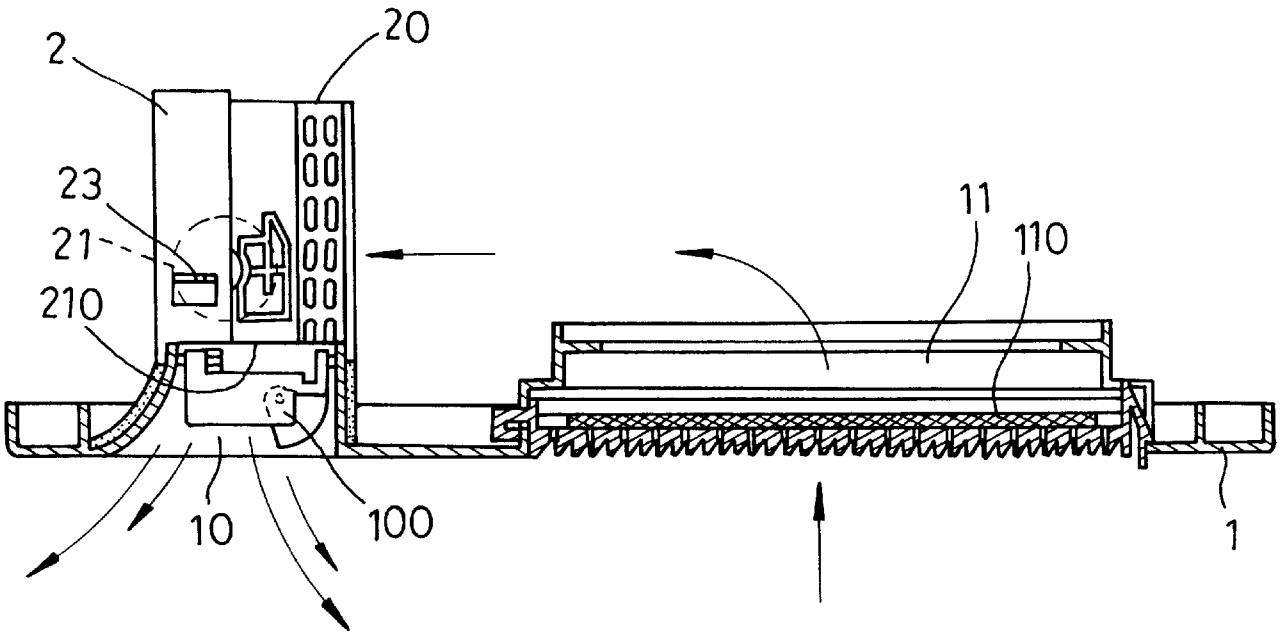
FIG. 4 is a sectional schematic view of the blower for an air conditioner with better effect in cold-air circulation in the present invention, showing the construction of the first preferred embodiment.

Therefore, the evaporator 20 of the cold-air blower 2 is capable of sucking in air in a short distance directly from the wind inlet 11 of the faceplate 1 to become cold air that will be promptly and powerfully blown out of the wind outlet 10 of the faceplate 1 by the fan 21 of the cold-air blower 2, as shown in FIG. 4, and can be blown evenly under the automatic turning movements of the adjusting leaves 100 so as to achieve a better effect in cold-air circulation.

Figure 5:
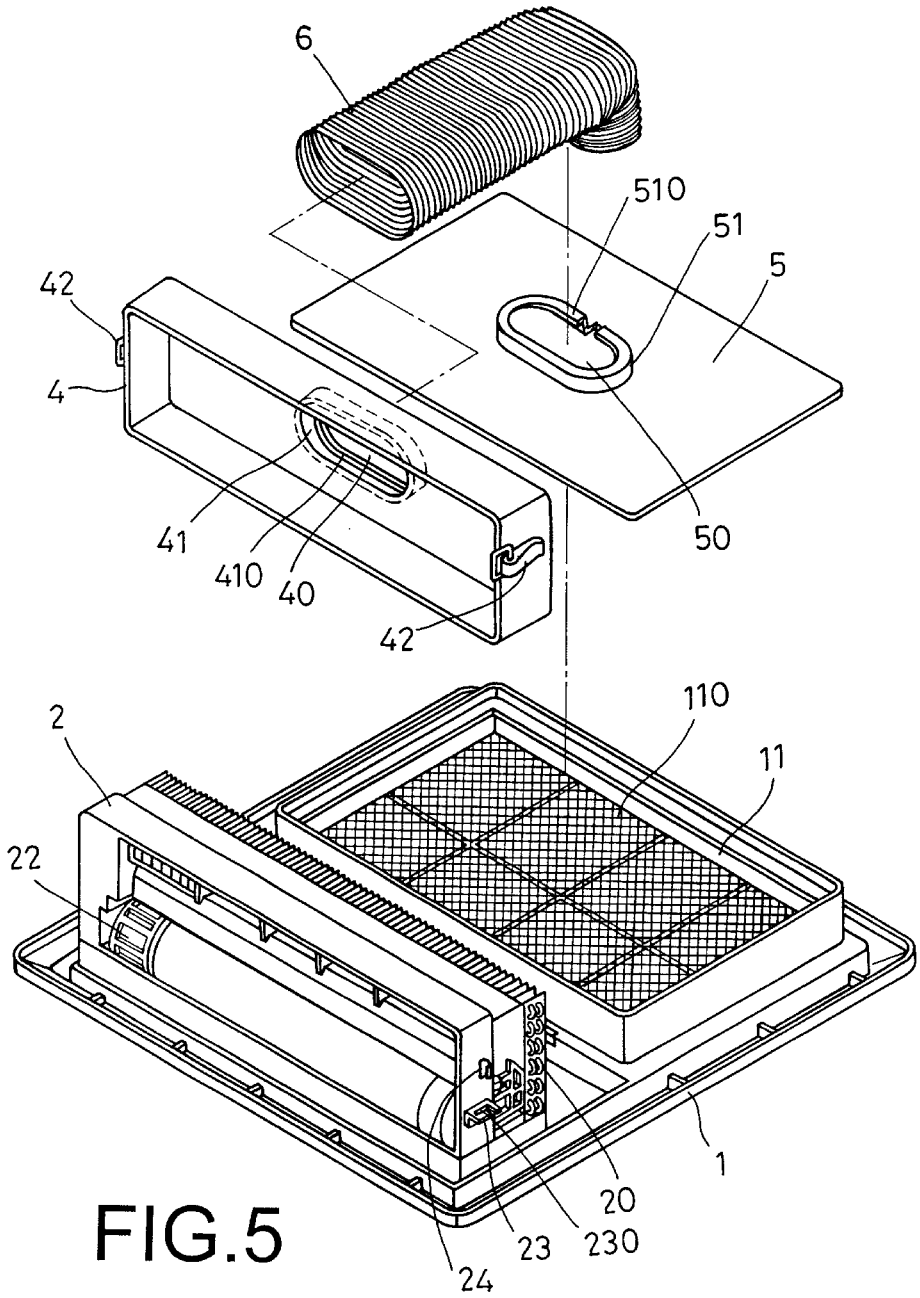
FIG. 5 is an exploded perspective view of the blower for an air conditioner with better effect in cold-air circulation in the present invention, showing the construction of a second preferred embodiment.
Figure 6:
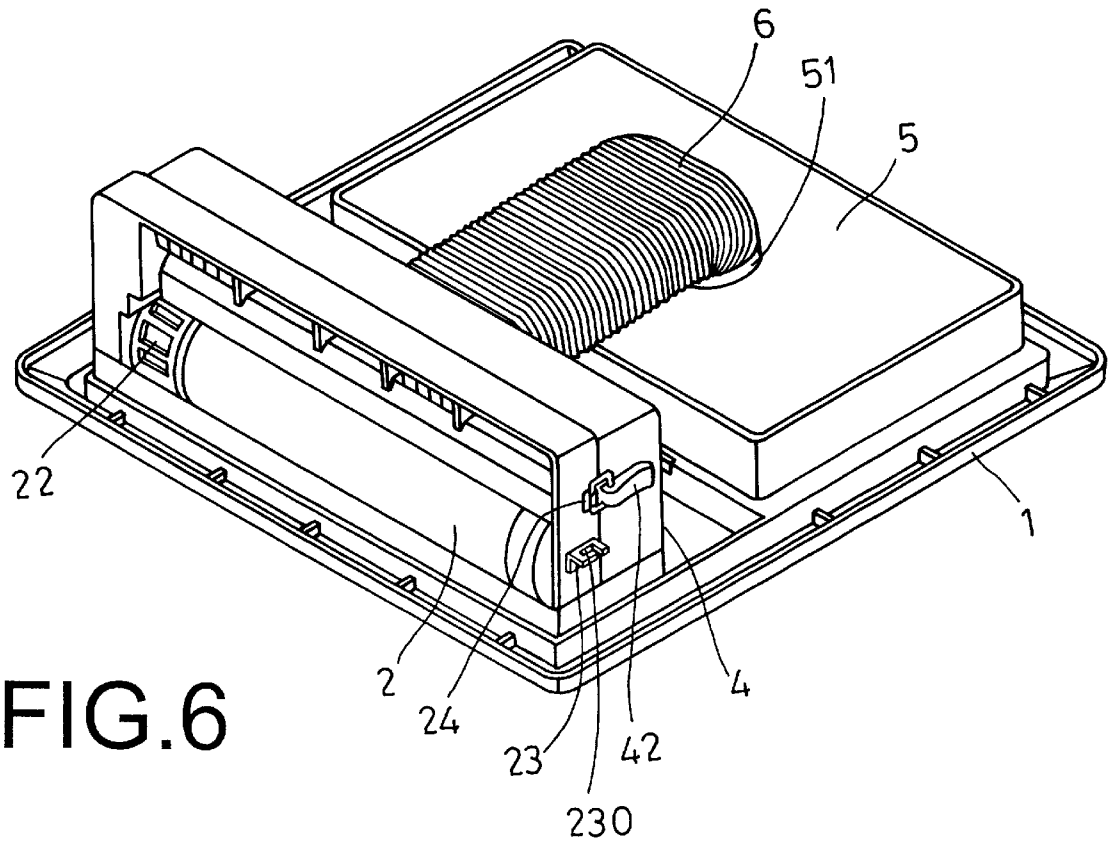
FIG. 6 is a perspective view of the blower for an air conditioner with better effect in cold-air circulation in the present invention, showing the construction of the second preferred embodiment.
Figure 7:
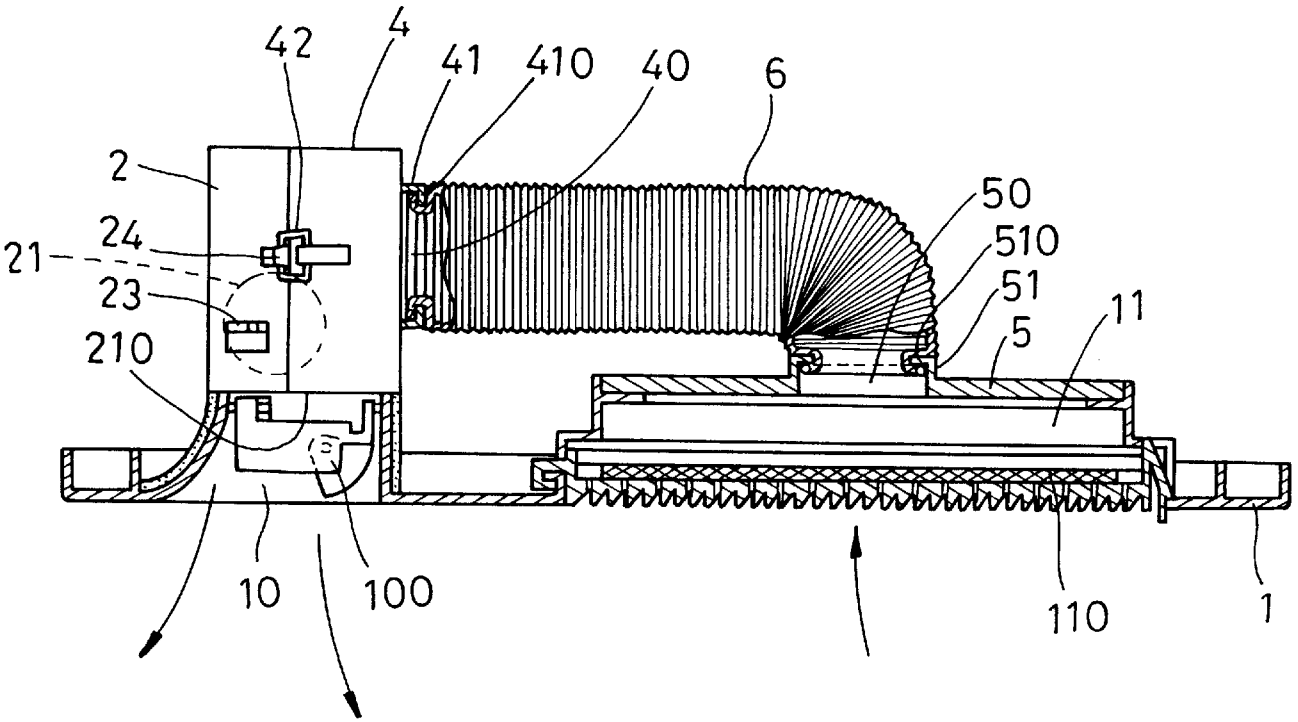
FIG. 7 is a sectional schematic view of the blower for an air conditioner with better effect in cold-air circulation in the present invention, showing the construction of the second preferred embodiment.

A second preferred embodiment of a blower for an air conditioner with better effect in cold-air circulation in the present invention, as shown in FIGS. 5 to 7, mainly includes a faceplate 1, at least one cold-air blower 2, at least one wind-in cover 4 and at least one wind-in cover 5.

The faceplate 1 also has at least one wind outlet 10 and at least one wind inlet 11. Each of the wind outlets 10 has a plurality of adjusting leaves 100 disposed therein and capable of automatically turning direction. Each of the wind inlets 11 has an openable filter-net grille 110 disposed therein.

Each of the cold-air blowers 2 is located on each of the wind outlets 10 of the faceplate 1 and also has an evaporator 20, a fan 21, a motor 22 disposed at one side of the fan 21 and actuating the fan 21, two positioning plates 23 each provided with a slot 230, and two hook members 24. The fan 21 has a wind-blowing opening 210 aligned with each of the wind outlets 10 of the faceplate 1.

Each of the wind-out covers 4 is covered on each of the cold-air blowers 2 and has at least one through hole 40 disposed therein and two fasteners 42 respectively disposed at both sidewalls thereof. Each of the through holes 40 has a windpipe base 41 extending outwardly and provided with an engagement edge 410 for being quickly engaged with a windpipe 6 in position. The two fasteners 42 are just capable of being firmly hooked by the two hook members 24.

Each of the wind-in covers 5 is covered on each of the wind inlets 11 of the faceplate 1 and has at least one through hole 50 disposed therein. Each of the through holes 50 has a windpipe base 51 extending outwardly and provided with an engagement edge 510 and is connected with each of the through holes 40 of the wind-out cover 4 by a windpipe 6 capable of being quickly engaged with the engagement edges 410, 510 of the windpipe base 41 and the windpipe base 51.

Therefore, the cold-air blower 2 is capable of sucking in air directly from the wind inlet 11 of the faceplate 1 to become cold air that will be powerfully and evenly blown out of the wind outlet 10 of the faceplate 1 by the fan 21 of the cold-air blower 2 so as to achieve a better effect in cold-air circulation.

Figure 8:
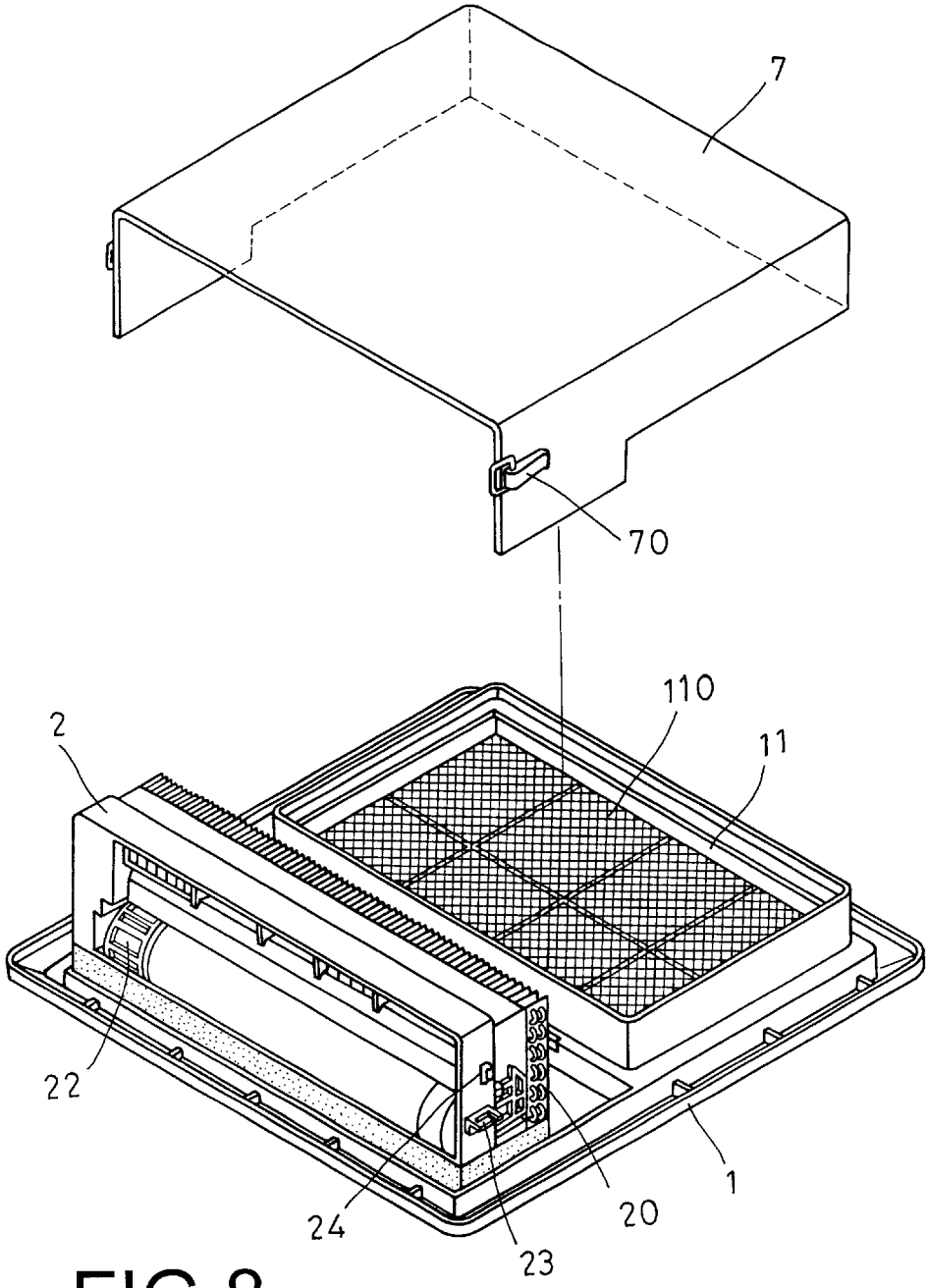
FIG. 8 is an exploded perspective view of the blower for an air conditioner with better effect in cold-air circulation in the present invention, showing the construction of a third preferred embodiment.
Figure 9:
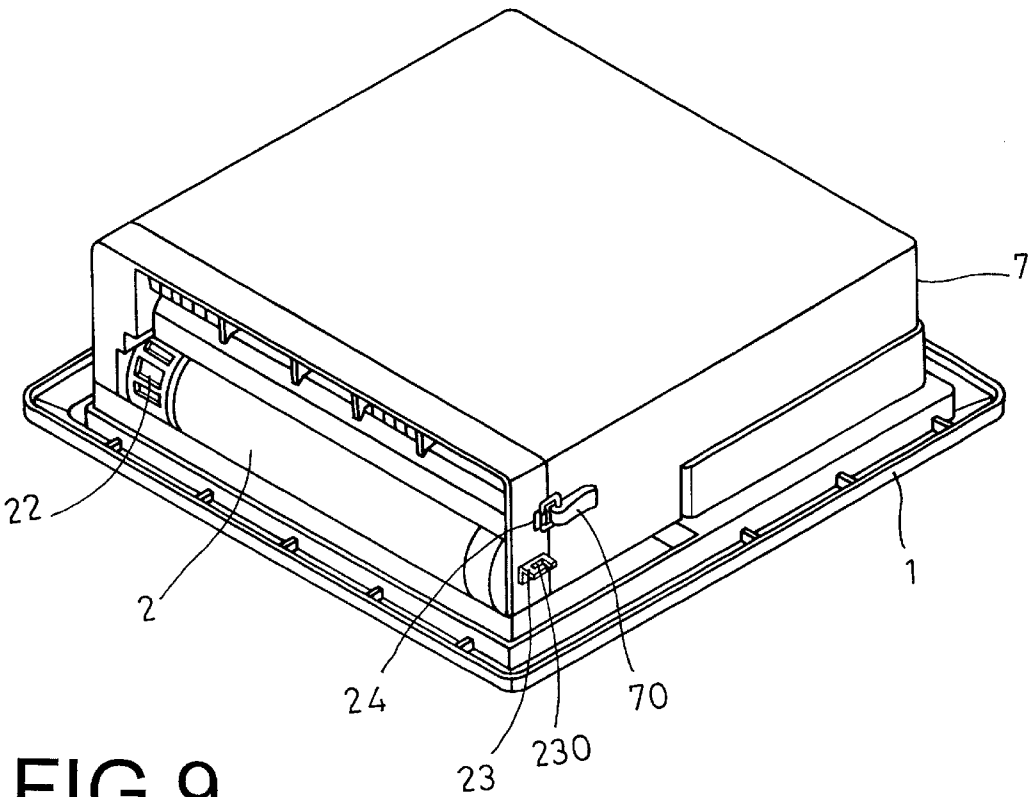
FIG. 9 is a perspective view of the blower for an air conditioner with better effect in cold-air circulation in the present invention, showing the construction of the third preferred embodiment.
Figure 10:
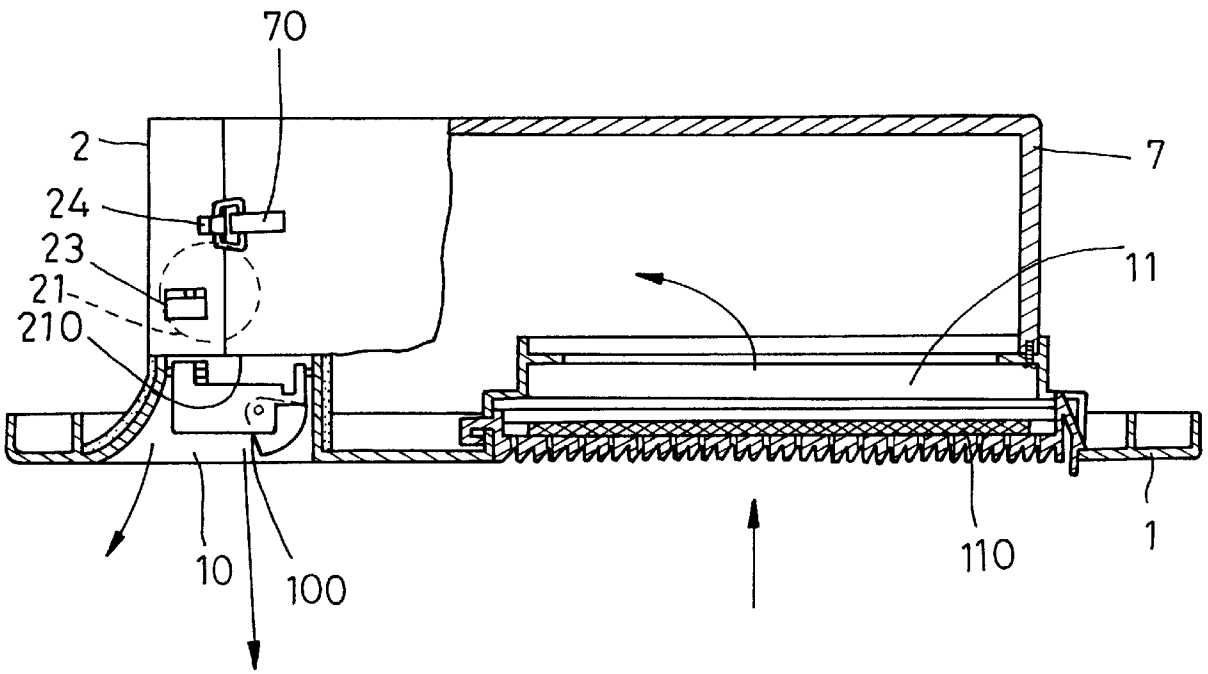
FIG. 10 is a sectional schematic view of the blower for an air conditioner with better effect in cold-air circulation in the present invention, showing the construction of the third preferred embodiment; and, FIG. 11 is a sectional schematic view of the blower for an air conditioner with better effect in cold-air circulation in the present invention, showing the construction and installation of a fourth preferred embodiment.

A third preferred embodiment of a blower for an air conditioner with better effect in cold-air circulation in the present invention, as shown in FIGS. 8 to 10, mainly includes a faceplate 1, at least one cold-air blower 2, and a wind-in cover 7.

The faceplate 1 also has at least one wind outlet 10 each provided with a plurality of adjusting leaves 100 disposed therein and capable of automatically turning direction. A wind inlet 11 provided with an openable filter-net grille 110 disposed therein.

Each of the cold-air blowers 2 is located on each of the wind outlet 10 of the faceplate 1 and also has an evaporator 20, a fan 21, a motor 22, two positioning plates 23, and two hook members 24. Each of the fans 21 has a wind-blowing opening 210 aligned with each of the wind outlets 10 of the faceplate 1.

The wind-in cover 7 is covered on the wind inlet 11 of the faceplate 1 and all of the cold-air blowers 2 and has at least one fastener 70 respectively disposed at each of both sidewalls thereof and capable of being firmly hooked by the two hook members 24 disposed at both sidewalls of the cold-air blower 2.

Therefore, the cold-air blower 2 is capable of sucking in air directly from the wind inlet 11 of the faceplate 1 to become cold air that will be powerfully and evenly blown out of the wind outlet 10 of the faceplate 1 by the fan 21 of the cold-air blower 2

Figure 11:
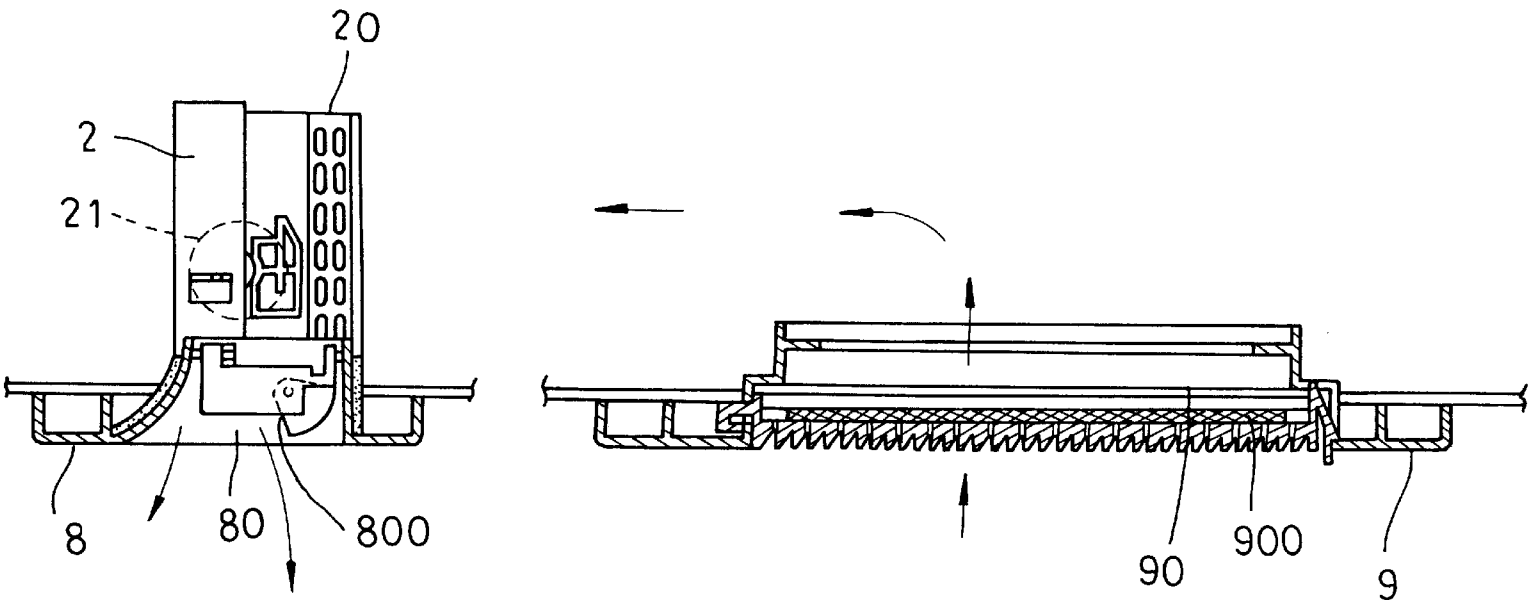

A fourth preferred embodiment of a blower for an air conditioner with better effect in cold-air circulation in the present invention, as shown in FIG. 11, mainly includes a first faceplate 8, a second faceplate 9, and at least one cold-air blower 2. The first faceplate 8 has at least one wind outlet 80 provided with a plurality of adjusting leaves 800 disposed therein and capable of automatically turning direction; the second faceplate 9 has at least one wind inlet 90 provided with an openable filter-net grille 900 disposed therein; each of the cold-air blowers 2 is located on each of the wind outlets 80 of the first faceplate 8, and has an evaporator 20, a fan 21 having a wind-blowing opening 210 aligned with each of the wind outlets 10 of the faceplate 1, a motor 22, and two positioning plates 23 each provided with a slot 230; and, whereby the first and second faceplates 8, 9 are respectively installed at two opposite and spaced sides of a ceiling constructed with steel frames so that the cold-air blowers 2 are capable of sucking in air directly from the wind inlets 90 of the second faceplate 9 and the evaporators 20 can make the air become cold air that will be promptly and powerfully blown out of the wind outlets 80 of the first faceplate 8, thereby forming the air in a room to be in convection and further providing a better effect in cold-air circulation.

While the preferred embodiments of the invention have been described above, it will be recognized and understood that various modifications may be made therein and the appended claims are intended to cover all such modifications that may fall within the spirit and scope of the invention.

What is claimed is:

1. A blower for an air conditioner with better effect in cold-air circulation comprising:

a faceplate having at least one wind outlet and at least one wind inlet; each of the wind outlets having a plurality of adjusting leaves disposed therein and capable of automatically turning direction; each of the wind inlets having an openable filter-net grille disposed therein;

a least one cold air blower; each of the cold-air blowers being located on each of the wind outlets of the faceplate and also having an vaporator, a fan, a motor disposed at one side of the fan and actuating the fan, two positioning plates each provided with a slot, and two hook members; the fan having a wind-blowing opening aligned with each of the wind outlets of the faceplate;

at lease one wind out covers; each of the wind-out covers being covered on each of the cold-air blowers and having at least one through hole disposed therein and two fasteners respectively disposed at both sidewalls thereof; each of the through holes having a windpipe base extending outwardly and provided with an engagement edge for being quickly engaged with a windpipe in position; the two fasteners being just capable of being firmly hooked by the two hook members;

at least one wind in cover; each of the wind-in covers being covered on each of the wind inlets of the faceplate and having at least one through hole disposed therein; each of the through holes having a windpipe base extending outwardly and provided with an engagement edge and being connected with each of the through holes of the wind-out cover by a windpipe capable of being quickly engaged with the engagement edges of the windpipe base and the windpipe base;

wherein the cold-air blower being capable of sucking in air directly from the wind inlet of the faceplate to become cold air that will be powerfully and evenly blown out of the wind outlet of the faceplate by the fan of the cold-air blower so as to achieve a better effect in cold-air circulation.

* * * * *